US010279466B2

(12) United States Patent
Livell

(10) Patent No.: US 10,279,466 B2
(45) Date of Patent: May 7, 2019

(54) SAW BLADE CADDY

(71) Applicant: Terry Livell, Arnold, MO (US)

(72) Inventor: Terry Livell, Arnold, MO (US)

( * ) Notice: Subject to any disclaimer, the term of this patent is extended or adjusted under 35 U.S.C. 154(b) by 0 days.

(21) Appl. No.: 15/892,323

(22) Filed: Feb. 8, 2018

(65) Prior Publication Data

US 2018/0222033 A1 Aug. 9, 2018

Related U.S. Application Data

(60) Provisional application No. 62/456,109, filed on Feb. 8, 2017.

(51) Int. Cl.

| | |
|---|---|
| ***B25H 3/02*** | (2006.01) |
| ***B65D 25/04*** | (2006.01) |
| ***B65D 43/02*** | (2006.01) |
| ***B65D 85/00*** | (2006.01) |
| ***B25H 3/00*** | (2006.01) |

(52) U.S. Cl.

CPC ..... *B25H 3/02* (2013.01); *B25H 3/006* (2013.01); *B65D 25/04* (2013.01); *B65D 43/0202* (2013.01); *B65D 85/54* (2013.01); *B65D 2543/00851* (2013.01)

(58) Field of Classification Search

CPC ..... B25H 3/02; B25H 3/006; B65D 25/04; B65D 85/54; A45C 13/02

USPC ..... 206/349, 454, 449, 445, 372; 220/555, 220/553, 557, 529, 532

See application file for complete search history.

(56) References Cited

U.S. PATENT DOCUMENTS

| | | | | | |
|---|---|---|---|---|---|
| 3,870,148 | A * | 3/1975 | Hite | B65D 25/04 | 206/309 |
| 3,876,072 | A * | 4/1975 | Phillips | B65D 5/721 | 206/303 |
| 4,889,232 | A * | 12/1989 | Asleson | B65D 25/107 | 206/449 |
| 5,184,749 | A * | 2/1993 | Attenasio | A47L 13/51 | 15/257.01 |
| 5,193,680 | A * | 3/1993 | Schumann | B65H 16/021 | 206/394 |
| 6,186,349 | B1 * | 2/2001 | Tempongko | B65D 11/02 | 206/309 |
| 7,172,068 | B1 * | 2/2007 | Griffin | B25H 3/023 | 206/349 |
| 7,520,386 | B1 * | 4/2009 | Griffin | B25H 3/00 | 206/303 |
| D655,346 | S * | 3/2012 | Tsai | D19/90 | |
| 2004/0262182 | A1 * | 12/2004 | Myer | A45C 11/24 | 206/349 |
| 2009/0134050 | A1 * | 5/2009 | Miller, III | B25H 3/02 | 206/374 |

* cited by examiner

*Primary Examiner* — Steven A Reynolds

(74) *Attorney, Agent, or Firm* — The Iwashko Law Firm, PLLC; Lev Ivan Gabriel Iwashko

(57) ABSTRACT

A saw blade caddy to store saw blades therein, the saw blade caddy including a box, a removable lid to attach to a top portion of the box, and a plurality of saw blade slots disposed vertically within the box to store the saw blades vertically therebetween.

4 Claims, 2 Drawing Sheets

SAW BLADE CADDY

CROSS REFERENCE TO RELATED APPLICATIONS

This application claims the benefit of U.S. Provisional Patent Application No. 62/456,109, filed Feb. 8, 2017 and entitled "SAW BLADE CADDY," the entire disclosure of which is incorporated herein by reference.

BACKGROUND

1. Field

The present general inventive concept relates generally to a caddy, and more particularly, to a saw blade caddy that facilitates storage of and access to various saw blades.

2. Description of the Related Art

Many individuals who own saws often find themselves trying to organize their saw blades into toolboxes, which may be a time-consuming task. Moreover, improper storage of saw blades may cause rusting due to exposure of various weather conditions which may be costly to replace.

Therefore, there is a need for a saw blade caddy that effortlessly stores saw blades and provides easy access to the saw blades.

SUMMARY

The present general inventive concept is directed to a saw blade caddy that facilitates storage of and access to various saw blades.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a saw blade caddy to store saw blades therein, the saw blade caddy including a box, a removable lid to attach to a top portion of the box, and a plurality of saw blade slots disposed vertically within the box to store the saw blades vertically therebetween.

The removable lid may include a handle to allow the removable lid to be removed from the box.

The removable lid may include hinges to correspond with and connect to hinge receiving portions of the box, such that the box may be opened without removing the removable lid.

The plurality of saw blade slots may be disposed at predetermined distances from each other to allow the saw blades to be vertically stored therebetween.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
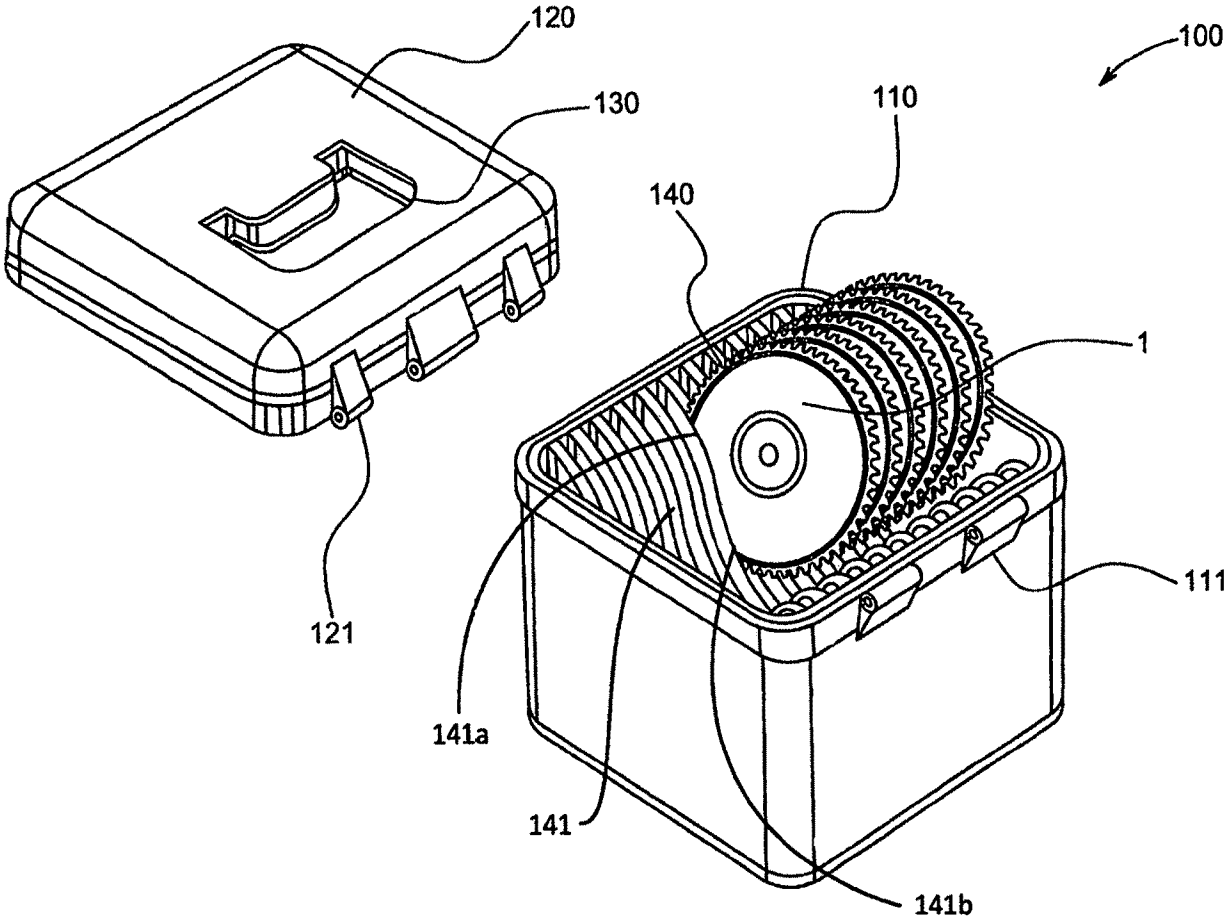
FIG. 1 illustrates a top-angled exploded view of a saw blade caddy in an open position, according to an exemplary embodiment of the present general inventive concept.

FIG. 1 illustrates a top-angled exploded view of a saw blade caddy 100 in an open position, according to an exemplary embodiment of the present general inventive concept.

The saw blade caddy 100, and components thereof, may be made of high-impact injection molded plastic, metal, rubber, or other suitable material known to one of ordinary skill in the art.

Figure 2:
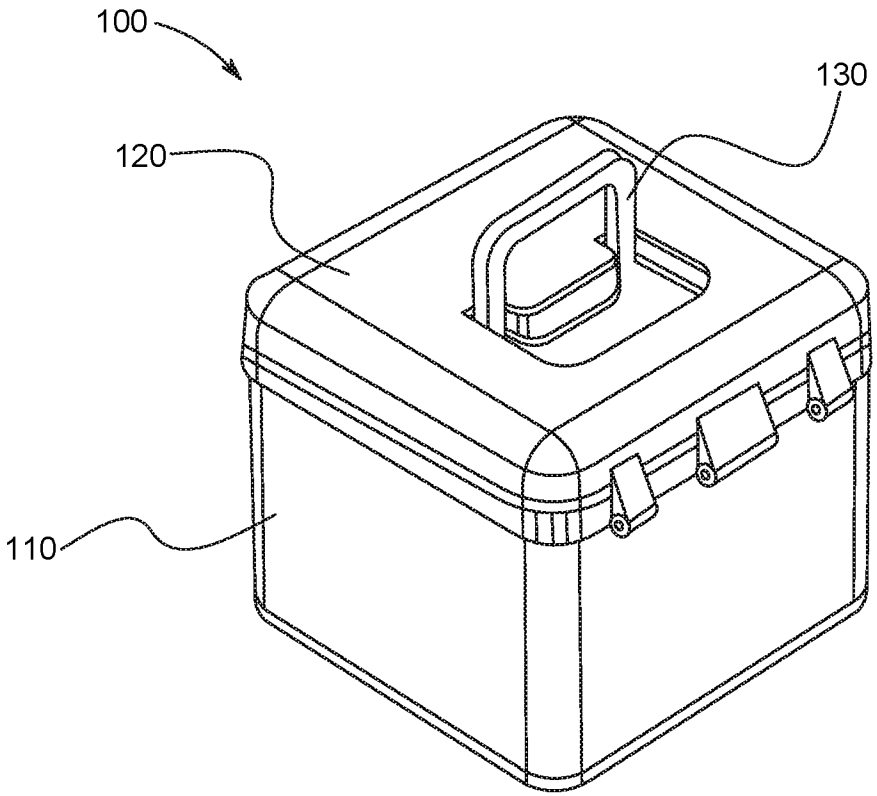
FIG. 2 shows a top-angled view of a saw blade caddy in a closed position, according to an exemplary embodiment of the present general inventive concept.

FIG. 2 illustrates a top-angled view of the saw blade caddy 100 in a closed position, according to an exemplary embodiment of the present general inventive concept.

Referring to FIG. 1, the saw blade caddy 100 may include a box 110, a lid 120, a handle 130 and plurality of saw blade slots 140.

The lid 120 may be removably attached to a top surface of the box 110.

The lid 120 may include hinges 121, which may be attached to hinge receiving portions 111 of the box 110, which may allow the lid 120 to be opened with respect to the box 110 without removing the lid 120 from the box 110.

In operation, the saw blade caddy 100 features capabilities of effortlessly storing wood, metal, cement, and circular saw blades 1 measuring up to approximately 24 inches in diameter and a handle for easy portability, but is not limited thereto.

More specifically, a user may insert the saw blades 1 into the plurality of saw blade slots 140 when the lid 120 is removed from the box 110 via the handle 130. Since the plurality of saw blade slots 140 are designed to disposed vertically within the box to be spaced apart from each other at predetermined distances conducive to store saw blades 1 vertically therebetween, the user may insert into and extract therefrom saw blades 1 from the plurality of saw blade slots 140 with ease.

Furthermore, the box 110 may Include a plurality of spacers 141. The plurality of saw blade slots 140 may be spaced apart from each other at predetermined distances based on corresponding widths of the plurality of spacers 141. In other words, the widths of each of the plurality of spacers 141 may at least partially determine the widths of the plurality of saw blade slots 140. Moreover, the plurality of spacers 141 may extend downward from a first end of the box 110 to a second end of the box 110. Furthermore, the plurality of spacers 141 near the first end of the box 110 may have a convex shape 141*a*, and the plurality of spacers 141 may have a concave shape 141*b* near the second end of the box 110. In other words, the plurality of spacers 141 may form the plurality of saw blade slots 140, such that each of the plurality of spacers 141 slopes downward from a first end of the box 110 to a second end of the box 110, such that a first portion of each of the plurality of spacers 141 near the first end of the box 110 is convex and a second portion of each of the plurality of spacers 141 near the second end of the box 110 is concave.

Referring to FIG. 2, the handle 130 may swivel up and down to allow removal or opening of the lid 120.

The saw blade caddy 100 is designed with the sturdy lid 120 that may be manufactured by injection molding with high impact plastic materials for optimal durability. The saw blade caddy 100 is essential for the everyday consumer and may be readily available at hardware stores, home improvement stores and industry specific retailers.

In one exemplary embodiment of the present general inventive concept, the saw blade caddy facilitates storing various saw blades.

In one exemplary embodiment of the present general inventive concept, the saw blade caddy stores various saw blades and affords easy access to those stored saw blades.

In one exemplary embodiment of the present general inventive concept, the saw blade caddy is made of high-impact injection molded plastic for durability.

The Applicant's general inventive concept described herein provides for a saw blade caddy that facilitates storing various saw blades. The primary operative steps in Applicant's saw blade caddy are to simply place any blade into the container for easy storage and access when needed; the afforded slots prevent damage to the blades during transport. When in operation, the saw blade caddy is an innovative container which effortlessly stores saw blades and affords easy access. As a result, many of the limitations imposed by prior art structures are removed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A saw blade caddy to store saw blades therein, the saw blade caddy comprising:

a box, comprising;

a first wall, a second wall disposed parallel with respect to the first wall, a third wall disposed perpendicular with respect to the first wall and the second wall, and a fourth wall disposed parallel with respect to the third wall;

a removable lid to attach to top portions of each of the first wall, second wall, third wall, and fourth wall;

a plurality of saw blade slots disposed vertically within the box to store the saw blades vertically therebetween; and a plurality of spacers to form the plurality of saw blade slots, such that each of the plurality of spacers initially slopes downward from a top edge of the first wall toward the second wall, such that a first portion of each of the plurality of spacers near the first wall is convex and a second portion of each of the plurality of spacers near the second wall is concave.

2. The saw blade caddy of claim 1, wherein the removable lid comprises:

a handle to allow the removable lid to be removed from the box.

3. The saw blade caddy of claim 1, wherein the removable lid comprises:

hinges to correspond with and connect to hinge receiving portions of the box, such that the box may be opened without removing the removable lid.

4. The saw blade caddy of claim 1, wherein the plurality of saw blade slots are disposed at predetermined distances from each other to allow the saw blades to be vertically stored therebetween.

* * * * *